US010054100B2

(12) United States Patent
Minami

(10) Patent No.: US 10,054,100 B2
(45) **Date of Patent: *Aug. 21, 2018**

(54) MULTIPOINT SPARK PLUG AND MULTIPOINT IGNITION ENGINE

(71) Applicant: MIYAMA, INC., Nagano-shi (JP)

(72) Inventor: Katsuaki Minami, Nagano (JP)

(73) Assignee: MIYAMA, INC., Nagano-shi, Nagano (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/414,828

(22) Filed: Jan. 25, 2017

(65) Prior Publication Data

US 2017/0226982 A1 Aug. 10, 2017

(30) Foreign Application Priority Data

Feb. 9, 2016 (JP) ..... 2016-022982
Feb. 9, 2016 (JP) ..... 2016-022983
Jun. 13, 2016 (JP) ..... 2016-128127

(51) Int. Cl.
*H01T 13/46* (2006.01)
*F02P 15/02* (2006.01)
*F02P 15/08* (2006.01)
*H01T 13/22* (2006.01)

(52) U.S. Cl.
CPC ..... *F02P 15/02* (2013.01); *F02P 15/08* (2013.01); *H01T 13/22* (2013.01)

(58) Field of Classification Search
CPC ..... F02P 15/02; F02P 15/08; H01T 13/22; H01T 13/32; H01T 13/46; H01T 14/00
USPC ..... 123/169 EL, 169 MG, 636
See application file for complete search history.

(56) References Cited

U.S. PATENT DOCUMENTS 4,841,925 A * 6/1989 Ward ..... F02P 3/0884 123/143 B
6,064,143 A * 5/2000 Kagawa ..... H01T 13/14 123/169 EL
6,095,124 A * 8/2000 Matsubara ..... H01T 13/52 123/169 EL
6,225,752 B1 * 5/2001 Matsubara ..... H01T 13/38 123/169 EL (Continued)

FOREIGN PATENT DOCUMENTS

JP 57-131868 8/1982
JP 58-180775 10/1983

(Continued)

OTHER PUBLICATIONS

U.S. Appl. No. 15/414,937, filed Jan. 25, 2017.
Extended EP Search Report issued in corresponding EP Patent App. No. 17 15 4586, dated Jun. 6, 2017.

*Primary Examiner* — Hai Huynh
(74) *Attorney, Agent, or Firm* — Greer Burns & Crain Ltd.

(57) ABSTRACT

A multipoint spark plug for igniting an air-fuel mixture in a combustion chamber of an engine includes a main body portion that is formed in a flattened shape and inserted into an insertion hole of the engine such that a tip end portion thereof opposes the combustion chamber, a pair of side electrodes provided via a gap in a lengthwise direction of the tip end portion, and at least one intermediate electrode provided in the gap between the pair of side electrodes such that a plurality of ignition gaps are formed in the lengthwise direction of the tip end portion.

10 Claims, 7 Drawing Sheets

(56) References Cited

U.S. PATENT DOCUMENTS

| | | | | |
|---|---|---|---|---|
| 6,495,948 | B1 * | 12/2002 | Garrett, III | H01T 13/32 123/169 EL |
| 6,617,706 | B2 * | 9/2003 | Matsubara | H01T 13/39 307/10.1 |
| 6,628,050 | B1 * | 9/2003 | Kameda | H01T 13/20 313/141 |
| 6,748,917 | B1 * | 6/2004 | Hoffmann | F02B 17/005 123/295 |
| 6,796,299 | B2 * | 9/2004 | Isono | H01T 13/32 123/169 EL |
| 7,441,540 | B1 | 10/2008 | Minami | |
| 7,554,253 | B2 * | 6/2009 | Koyama | H01T 13/20 269/12 |
| 8,203,258 | B2 * | 6/2012 | Kameda | H01T 13/467 313/140 |
| 9,742,160 | B1 * | 8/2017 | Minami | H01T 13/08 |
| 9,780,534 | B2 * | 10/2017 | Chirila | H01T 13/20 |
| 2006/0028107 | A1 | 2/2006 | Hori et al. | |

FOREIGN PATENT DOCUMENTS

| | | |
|---|---|---|
| JP | 61-292875 | 12/1986 |
| JP | H2-102336 | 5/1992 |
| JP | 09-219274 | 8/1997 |
| JP | 2001-160475 | 6/2001 |
| JP | 2006-049206 | 2/2006 |
| JP | 2008-218204 | 9/2008 |
| JP | 2009-041366 | 2/2009 |

* cited by examiner

MULTIPOINT SPARK PLUG AND MULTIPOINT IGNITION ENGINE

TECHNICAL FIELD

The present invention relates to a multipoint spark plug having a plurality of ignition gaps, and a multipoint ignition engine including the multipoint spark plug.

BACKGROUND ART

JP2009-041366A discloses a multipoint ignition device in which a plurality of ignition gaps are formed by a plurality of intermediate members that are held by a head gasket interposed between a cylinder head and a cylinder block of an engine.

SUMMARY OF INVENTION

In the multipoint ignition device disclosed in JP2009-041366A, however, the entire head gasket must be exchanged in order to exchange a spark plug, and for this purpose, the cylinder head must be removed from the cylinder block.

The present invention has been designed in consideration of the problem described above, and an object thereof is to provide a multipoint spark plug and a multipoint ignition engine with which multipoint ignition can be achieved over a wide range and the multipoint spark plug can be exchanged easily.

According to one aspect of this invention, a multipoint spark plug configured to ignite an air-fuel mixture in a combustion chamber of an engine, includes: a main body portion formed in a flattened shape, the main body portion being inserted into an insertion hole of the engine such that a tip end portion thereof opposes the combustion chamber; a pair of side electrodes provided via a gap in a lengthwise direction of the tip end portion; and at least one intermediate electrode provided in the gap between the pair of side electrodes such that a plurality of ignition gaps are formed in the lengthwise direction of the tip end portion.

DESCRIPTION OF EMBODIMENT

A multipoint spark plug 100 according to an embodiment of the present invention and a multipoint ignition engine (referred to simply as an "engine" hereafter) 1 that includes the multipoint spark plug 100 will be described below with reference to the figures.

First, referring to FIGS. 1, 2A, and 2B, a configuration of the engine 1 will be described.

Figure 1:
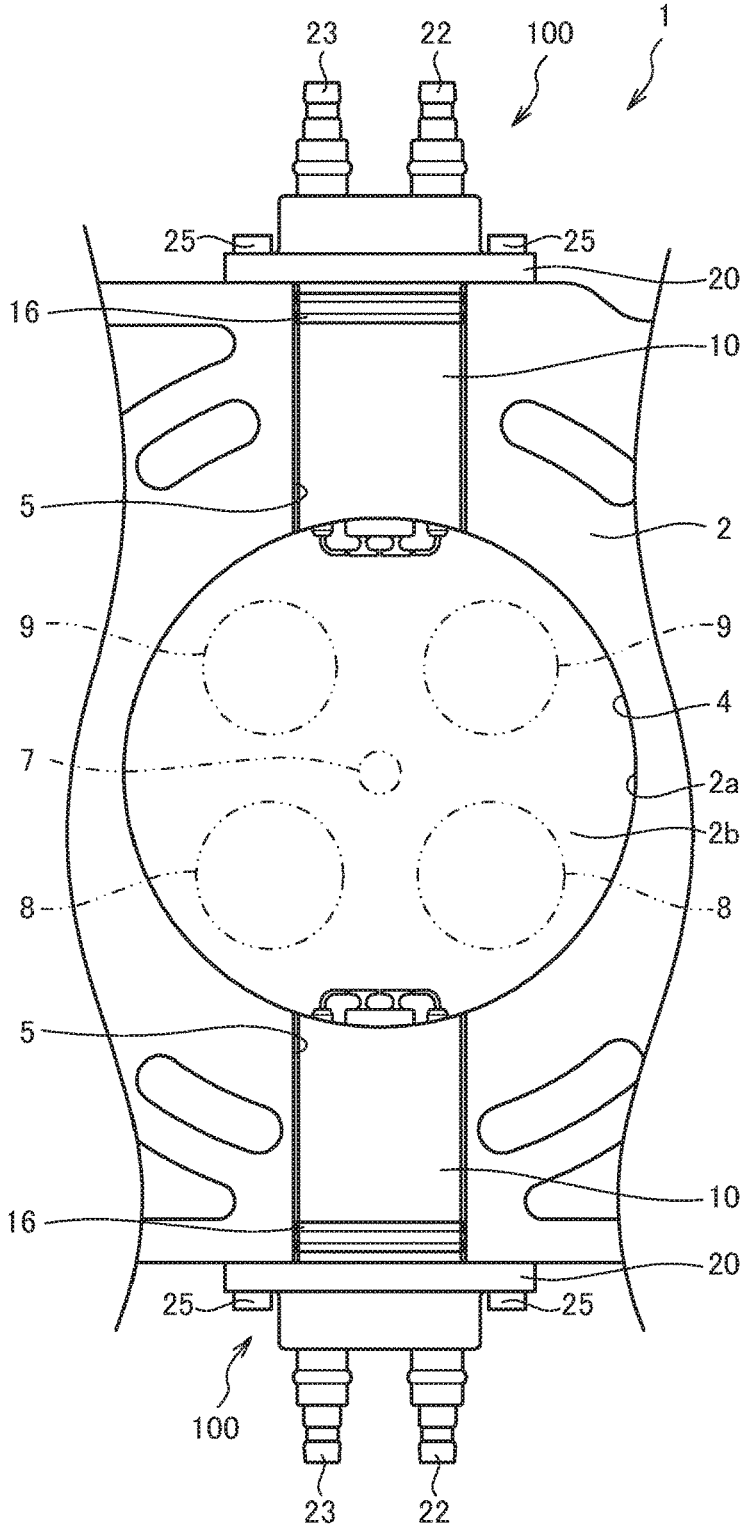
FIG. 1 is a view showing a combustion chamber of a multipoint ignition engine according to an embodiment of the present invention from an upper surface thereof.
Figure 2A:
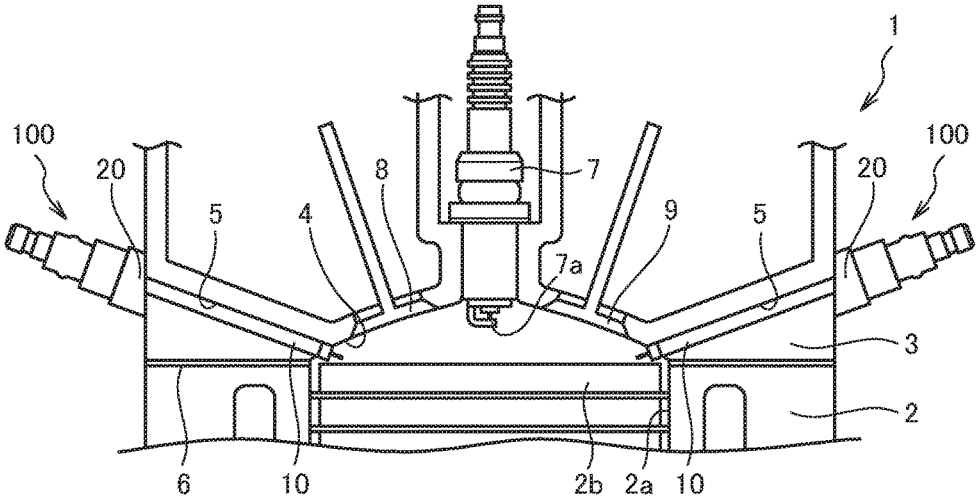
FIG. 2A is a side view of FIG. 1.
Figure 2B:
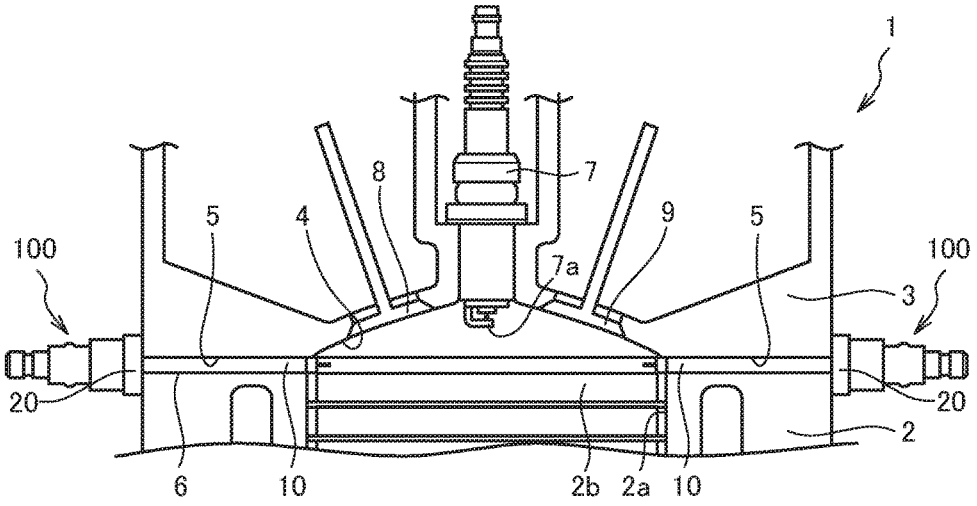
FIG. 2B is a side view illustrating a different attachment state in which a multipoint spark plug is attached to the multipoint ignition engine.

As shown in FIG. 1, the engine 1 includes a cylinder 2*a* formed in a cylinder block 2, a piston 2*b* that reciprocates through the cylinder 2*a*, and a cylinder head 3 (see FIG. 2A) that is attached to the cylinder block 2 in order to close a top portion of the cylinder 2*a*. A combustion chamber 4 is formed in the engine 1 by the cylinder 2*a*, the piston 2*b*, and the cylinder head 3. The engine 1 is a spark ignition type internal combustion engine that obtains power when the multipoint spark plug 100 ignites and burns a compressed air-fuel mixture in the combustion chamber 4 together with a spark plug 7. The spark plug 7 is provided in an upper portion of the combustion chamber 4, and the multipoint spark plug 100 is provided in a position removed from the spark plug 7.

The engine 1 includes a pair of insertion holes 5 into which the multipoint spark plug 100 is inserted. As shown in FIG. 2A, the insertion holes 5 are formed in the cylinder head 3. The present invention is not limited to this configuration, and as shown in FIG. 2B, the insertion holes 5 may be formed in a head gasket 6 provided between the cylinder block 2 and the cylinder head 3. Further, although not shown in the figures, the insertion holes 5 may be formed in the cylinder block 2. In other words, the insertion holes 5 are formed in any part of the engine 1 into which the multipoint spark plug 100 can be inserted.

The insertion holes 5 are through holes having a flattened, rounded-edge rectangular shape that corresponds to a main body portion 10 of the multipoint spark plug 100. In the engine 1, the insertion holes 5 are respectively formed in positions removed from the spark plug 7 on an intake valve 8 side and an exhaust valve 9 side of the combustion chamber 4 (in a lower end portion of the combustion chamber 4). Accordingly, one multipoint spark plug 100 is provided in a position removed from the spark plug 7 on the opposite side of the intake valve 8 thereto, and one multipoint spark plug 100 is provided in a position removed from the spark plug 7 on the opposite side of the exhaust valve 9 thereto. In the engine 1, ignition is performed by the multipoint spark plugs 100 in addition to the spark plug 7, and therefore a flame motion can be generated during combustion. Hence, fast combustion can be realized without providing a squish area, and as a result, cooling loss can be reduced.

It should be noted that the present invention is not limited to this configuration, and instead, the insertion holes 5 may be formed away from the spark plug 7 in locations within the combustion chamber 4 where the temperature of the air-fuel mixture is low, or in other words locations where knocking is more likely to occur. Further, the insertion hole 5 may be formed in a single location in the combustion chamber 4, or in a plurality of three or more locations. By forming the insertion holes 5 in accordance with the shape of the combustion chamber 4 in this manner, a desired number of multipoint spark plugs 100 can be provided.

Next, referring to FIGS. 3 to 6, a configuration of the multipoint spark plug 100 will be described.

Figure 3:
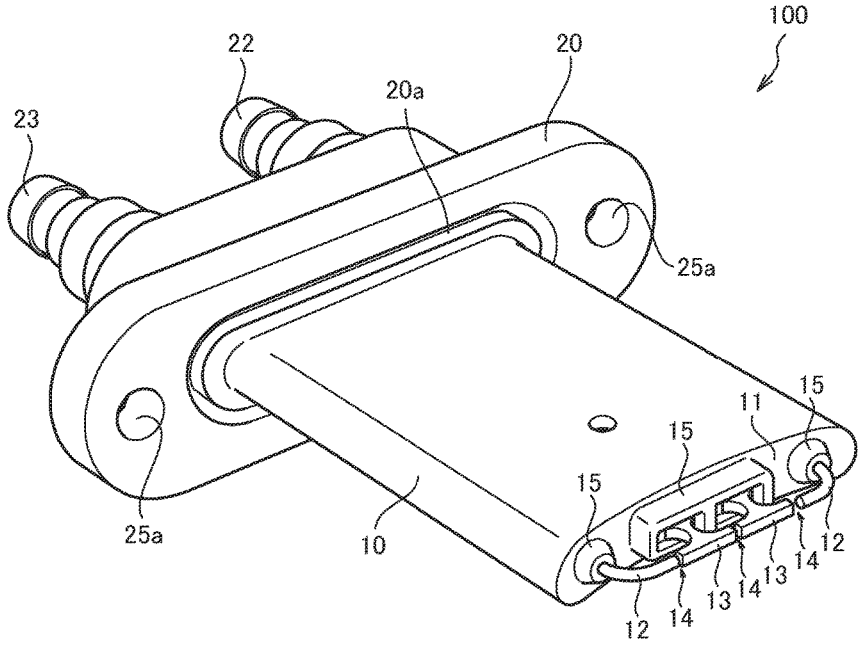
FIG. 3 is a perspective view of the multipoint spark plug.
Figure 4:
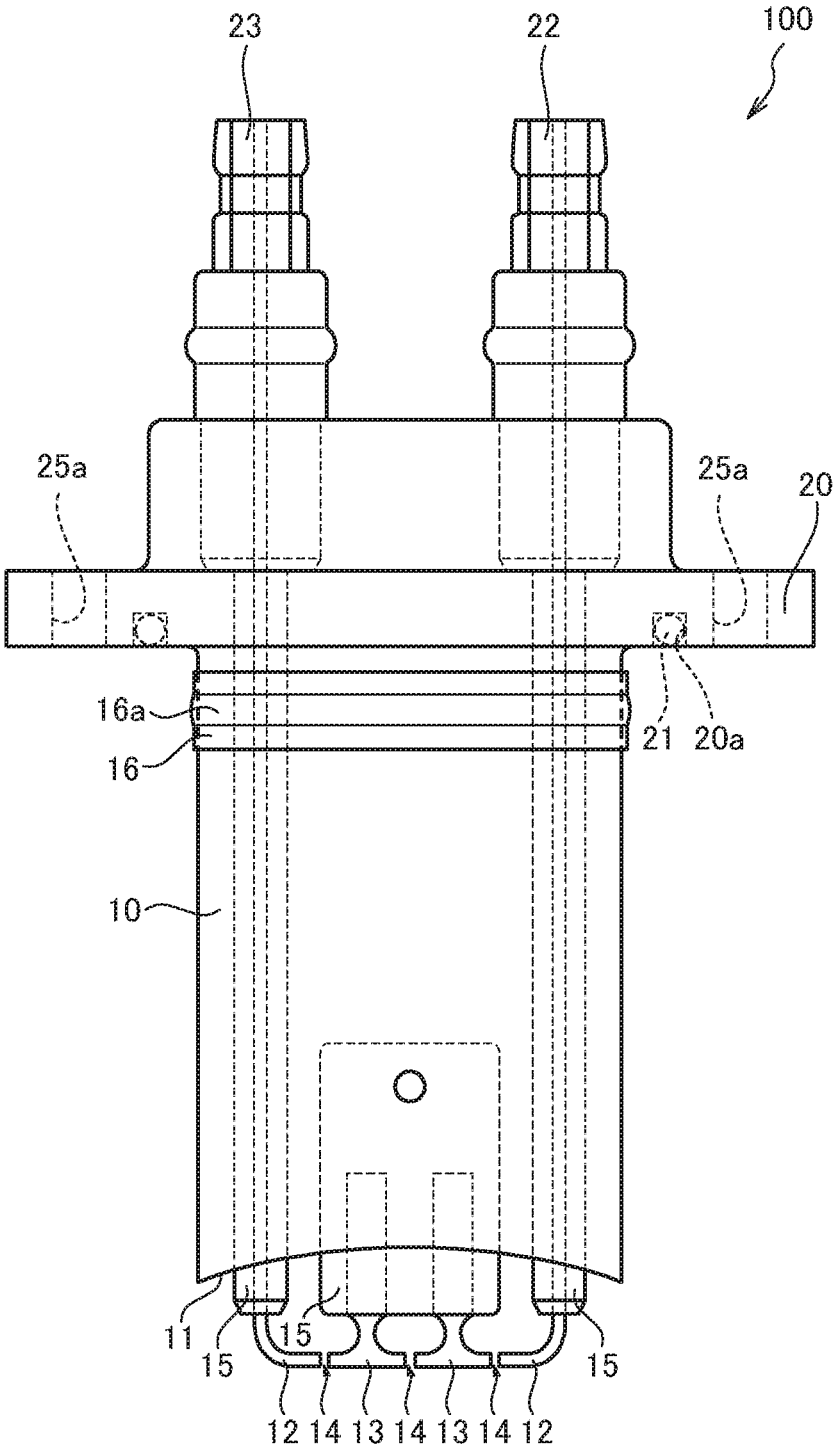
FIG. 4 is a plan view of FIG. 3.
Figure 5:
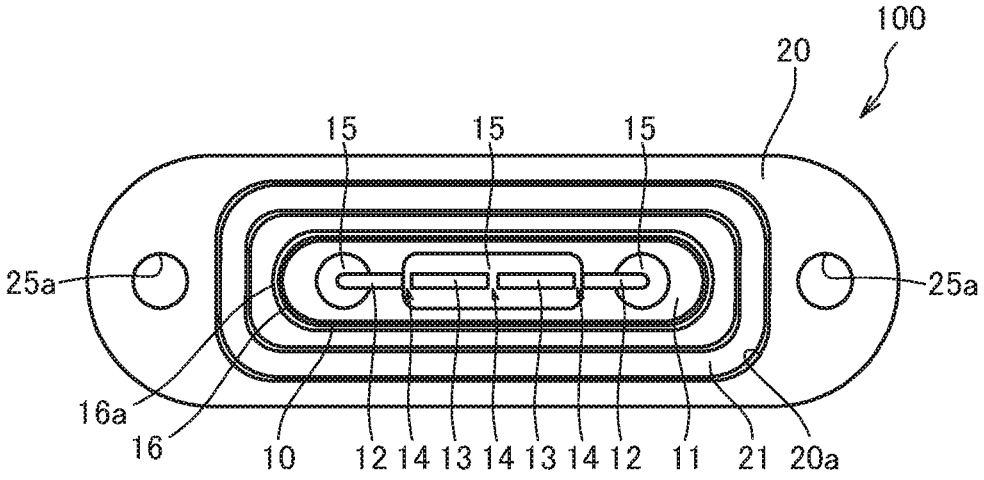
FIG. 5 is a front view of FIG. 3.

As shown in FIGS. 3 and 4, the multipoint spark plug 100 includes the main body portion 10 that is formed in a flattened shape and inserted into the insertion hole 5 in the cylinder head 3 so that a tip end portion 11 thereof opposes the combustion chamber 4, a pair of side electrodes 12 provided via a gap in a lengthwise direction of the tip end portion 11, intermediate electrodes 13 provided in the gap between the pair of side electrodes 12 so as to form a plurality of ignition gaps 14 in the lengthwise direction of the tip end portion 11, insulators 15 serving as electrode holding portions that project into the combustion chamber 4 from the tip end portion 11 and hold the side electrodes 12 and intermediate electrodes 13, and a flange portion 20 that is formed to be larger than the main body portion 10 and serves as an attachment portion that is attached to the cylinder head 3.

The main body portion 10 has a rounded-edge rectangle-shaped cross-section corresponding to the shape of the insertion hole 5, and is formed at a length corresponding to the insertion hole 5. The main body portion 10 is formed from a metal such as aluminum. By forming the main body portion 10 in a flattened shape, a surface area of the multipoint spark plug 100 that is within the combustion chamber 4 can be reduced in comparison with a case where electrodes 17 forming the plurality of ignition gaps 14 are provided but the main body portion 10 is not formed in a flattened shape. As a result, the multipoint spark plug 100 can be disposed in the combustion chamber 4 with a greater degree of freedom.

As shown in FIG. 4, a metal gasket 16 is wound around the main body portion 10 as a first sealing material that closes a gap between the main body portion 10 and the insertion hole 5. The metal gasket 16 will be described in further detail below.

The tip end portion 11 is formed in an identical shape to an inner periphery of the combustion chamber 4, and forms a part of the inner periphery of the combustion chamber 4. More specifically, the tip end portion 11 is formed in a spherical surface shape that has an identical radius to the hemispherical combustion chamber 4 when the multipoint spark plug 100 is attached to the cylinder head 3 in which the hemispherical combustion chamber 4 is provided. Further, the tip end portion 11 is formed in a curved surface shape that has an identical radius to an inner periphery of the cylinder 2*a* when the multipoint spark plug 100 is attached to the head gasket 6.

The side electrodes 12 are held on the main body portion 10 via the insulators 15. The side electrodes 12 project further into the combustion chamber 4 from the insulators 15. The side electrodes 12 are formed so as to project from the tip end portion 11 in an L shape. One of the side electrodes 12 (a first side electrode 12) penetrates the main body portion 10 and the flange portion 20 so as to extend to an input terminal 22, to be described below. The other side electrode 12 (a second side electrode 12) penetrates the main body portion 10 and the flange portion 20 similarly so as to extend to a connection terminal 23, to be described below. The pair of side electrodes 12 are provided so that respective tip ends thereof face each other. An ignition current from an ignition coil (not shown) is input into the first side electrode 12 via the input terminal 22.

The intermediate electrodes 13 are provided in a pair and disposed between the pair of mutually opposing side electrodes 12. The intermediate electrodes 13 are held on the main body portion 10 via the insulator 15. The intermediate electrodes 13 project further into the combustion chamber 4 from the insulator 15. In contrast to the side electrodes 12, the intermediate electrodes 13 do not penetrate the main body portion 10. Instead, the intermediate electrodes 13 are held on the main body portion 10 by being inserted partially therein.

The intermediate electrodes 13 are disposed in a straight line so as to form three ignition gaps 14 at equal intervals between the pair of mutually opposing side electrodes 12. By forming the plurality of ignition gaps 14 on the tip end portion 11 of the flattened main body portion 10 so as to extend in the lengthwise direction in this manner, multipoint ignition can be implemented over a wide range of the combustion chamber 4.

The intermediate electrode 13 may be provided singly, or in a plurality of three or more. The number of intermediate electrodes 13 may be set as desired in accordance with a lengthwise direction dimension of the tip end portion 11 of the main body portion 10, a designed number of ignition gaps 14, and so on.

The intermediate electrodes 13 are formed so as to project from the tip end portion 11 in a T shape. In so doing, the ignition current input into the first side electrode 12 from the ignition coil can pass through the ignition gaps 14 in a straight line and flow into the second side electrode 12. As a result, sparks can be generated reliably in the ignition gaps 14.

The insulators 15 insulate the side electrodes 12 and the intermediate electrodes 13 from the main body portion 10. The insulators 15 that hold the side electrodes 12 project partially from the tip end portion 11, and are formed to be long enough to penetrate the main body portion 10 and the flange portion 20. The insulator 15 that holds the intermediate electrodes 13 projects partially from the tip end portion 11, and is formed at a size enabling a part thereof to be inserted into the interior of the main body portion 10.

Figure 6:
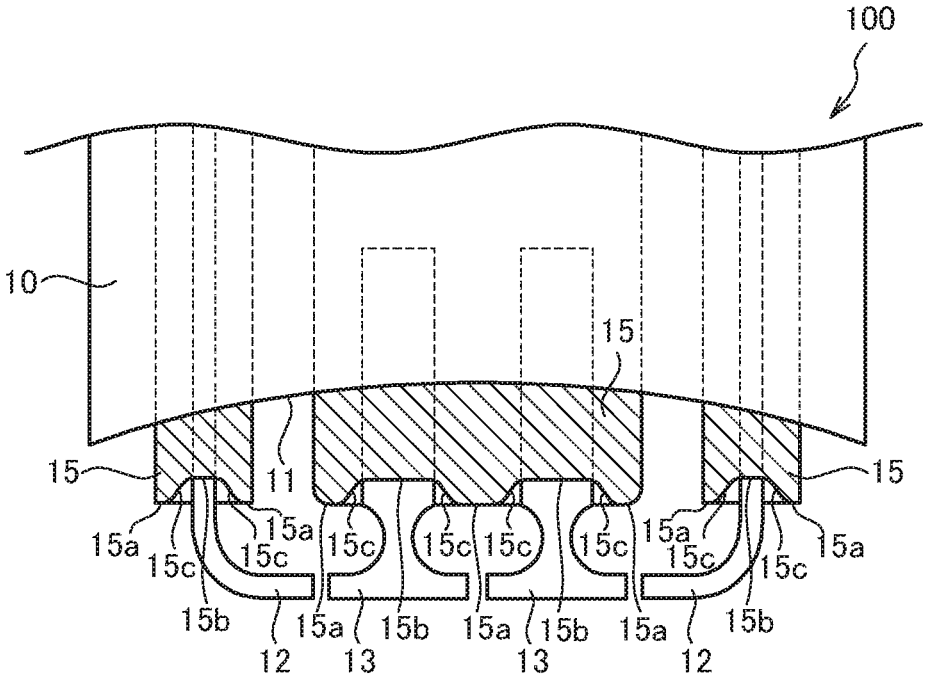
FIG. 6 is a view showing a cross-section of an insulator and illustrating relationships of the insulator to side electrodes and intermediate electrodes.

As shown in FIG. 6, each insulator 15 includes a bottom surface 15*b* formed so as to be recessed from a tip end surface 15*a* in order to hold outer peripheries of the side electrodes 12 and intermediate electrodes 13, and curved surface portions 15*c* that connect the bottom surface 15*b* to the tip end surface 15*a* smoothly, and are formed in a curved surface shape that moves gradually further away from the side electrodes 12 and intermediate electrodes 13 from the bottom surface 15*b* toward the tip end surface 15*a*. The insulators 15 are formed from a material having an insulating property, such as a ceramic.

By forming the curved surface portions 15*c* in this manner, a path from the side electrodes 12 and intermediate electrodes 13 to the outer periphery of the main body portion 10 is longer than in a case where the bottom surface 15*b* is not formed so as to be recessed from the tip end portion 15*a*. As a result, a situation in which the side electrodes 12 and intermediate electrodes 13 short-circuit to the cylinder head 3 via the outer periphery of the main body portion 10 can be prevented from occurring.

As shown in FIG. 1, the metal gasket 16 is wound around the outer periphery of the main body portion 10 of the multipoint spark plug 100 when the main body portion 10 is to be inserted into the insertion hole 5. As a result, the metal gasket 16 seals the gap between the main body portion 10 and the insertion hole 5 when the multipoint spark plug 100 is attached. The metal gasket 16 is formed from a metal material. As shown in FIG. 4, the metal gasket 16 includes a bead portion 16*a* that projects around an outer periphery thereof.

The bead portion 16*a* projects in an annular shape from substantially the center of the metal gasket 16 toward an outer periphery thereof. By providing the bead portion 16*a*, the gap between the main body portion 10 and the insertion hole 5 can be sealed without being affected by errors in the inner periphery of the insertion hole 5 and the outer periphery of the main body portion 10 or the like.

The flange portion 20 is formed around the entire periphery of the main body portion 10 so as to project from the main body portion 10 toward the outer periphery thereof. The flange portion 20 is formed integrally with the main body portion 10 from a metal such as aluminum. The flange portion 20 includes a pair of fastening holes 25*a*. The flange portion 20 is fastened to an outer surface of the cylinder head 3 by a pair of bolts 25 inserted into the fastening holes 25*a*. An O-ring 21 is provided on the flange portion 20 as a second sealing material that seals a contact surface between the flange portion 20 and the cylinder head 3.

The O-ring 21 is inserted into an O-ring groove 20*a* formed in an annular shape in a surface of the flange portion 20 that opposes the main body portion 10. The O-ring 21 is formed from a rubber material.

The O-ring 21 is compressed between the flange portion 20 and the cylinder head 3 by a fastening force of the bolts 25. Accordingly, when the flange portion 20 is fastened to the cylinder head 3, the O-ring 21 seals the gap between the main body portion 10 and the insertion hole 5.

In the engine 1, the gap between the main body portion 10 of the multipoint plug 100 and the insertion hole 5 of the engine 1 is sealed doubly by the metal gasket 16 and the O-ring 21, but the gap may be sealed by only one of the metal gasket 16 and the O-ring 21.

The flange portion 20 includes the input terminal 22, which is connected to the first side electrode 12 and receives the ignition current from the ignition coil, and the connection terminal 23, which is connected to the second side electrode 12 and to the input terminal 22 of the other multipoint spark plug 100.

As a result, the pair of the multipoint spark plugs 100 provided in the single combustion chamber 4 can be connected in series via a plug cord (not shown) so as to perform ignition simultaneously. Further, the spark plug 7 can be connected in series to the ends of the pair of multipoint spark plugs 100 via a plug cord (not shown) so as to perform ignition simultaneously therewith. At this time, an earth electrode 7*a* (see FIG. 2A) of the spark plug 7 is earthed by being brought into contact with the cylinder head 3.

Next, an operation for exchanging the multipoint spark plug 100 will be described.

To exchange the multipoint spark plug 100, first, the pair of bolts 25 are removed and the main body portion 10 is withdrawn from the insertion hole 5 in the engine 1. Next, the metal gasket 16 is wound around the main body portion 10 of the new multipoint spark plug 100, and the O-ring 21 is inserted into the O-ring groove 20*a*. The new multipoint spark plug 100 is then inserted into the insertion hole 5 in the engine 1. Next, the pair of bolts 25 are inserted into the fastening holes 25*a* and fastened, whereby exchange of the multipoint spark plug 100 is complete.

Hence, the multipoint spark plug 100 can be exchanged simply by withdrawing the multipoint spark plug 100 from the insertion hole 5 in the engine 1 and inserting the new multipoint spark plug 100, and as a result, the multipoint spark plug 100 can be exchanged easily.

Moreover, at this time, the multipoint spark plug 100, in contrast to the spark plug 7, does not have to be rotated so as to be screwed to a female screw formed in the cylinder head 3, and therefore the side electrodes 12 and intermediate electrodes 13 can be disposed reliably in prescribed positions within the combustion chamber 4. Hence, the positions of the ignition gaps 14 do not change even when the multipoint spark plug 100 is exchanged, and as a result, the air-fuel mixture can be burned as designed.

According to the embodiment described above, following effects are obtained.

In the multipoint spark plug 100, the plurality of ignition gaps 14 are formed to extend in the lengthwise direction along the tip end portion 11 of the flattened main body portion 10, and therefore multipoint ignition can be achieved over a wide range. Further, the flattened main body portion 10 is inserted into the insertion hole 5 in the engine 1 so that the tip end portion 11 thereof opposes the combustion chamber 4. Therefore, the multipoint spark plug 100 can be exchanged simply by withdrawing the multipoint spark plug 100 from the insertion hole 5 in the engine 1 and inserting the new multipoint spark plug 100. Hence, with the multipoint spark plug 100 and the engine 1, multipoint ignition can be achieved over a wide range, and the multipoint spark plug 100 can be exchanged easily.

Embodiments of this invention were described above, but the above embodiments are merely examples of applications of this invention, and the technical scope of this invention is not limited to the specific constitutions of the above embodiments.

Figure 7:
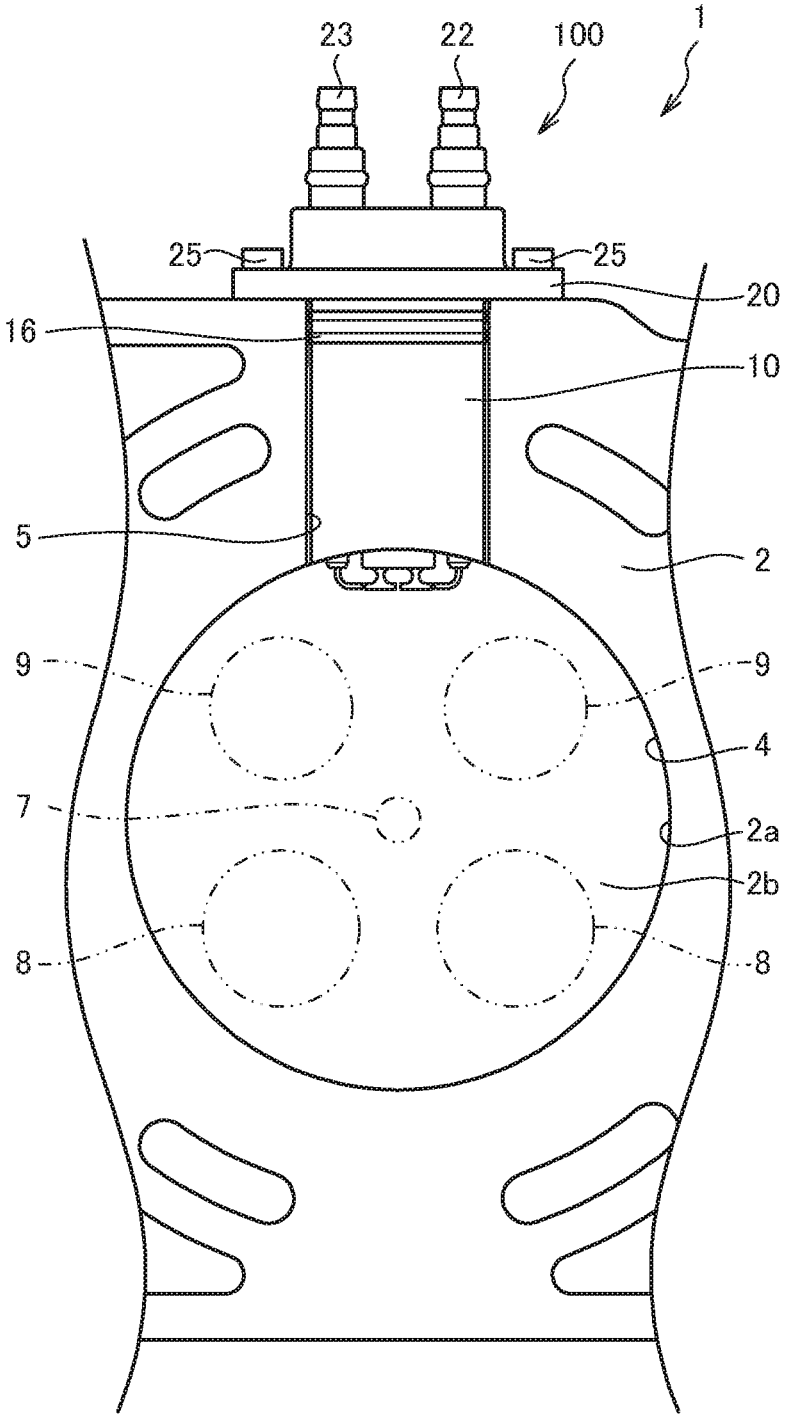
FIG. 7 is a view showing a combustion chamber of a multipoint ignition engine according to a modified example of this embodiment of the present invention from an upper surface thereof.

For example, as shown in FIG. 7, the multipoint spark plug 100 may be provided only in a position removed from the spark plug 7 on the opposite side of the exhaust valve 9 thereto. In this case, ignition is performed by the multipoint spark plug 100 in the vicinity of the exhaust valve 9, and therefore amounts of nitrogen oxide ($NO_x$) and so on generated during combustion of the air-fuel mixture can be reduced.

Further, in the above embodiment, the air-fuel mixture in the combustion chamber 4 is ignited by both spark plug 7 and the multipoint spark plugs 100, but the spark plug 7 may be omitted so that the multipoint spark plugs 100 are provided alone. In a case where an inner diameter (a bore diameter) of the combustion chamber 4 is comparatively small, for example, fast combustion can be realized in a similar manner to the above embodiment even when ignition is performed by the multipoint spark plugs 100 alone.

Furthermore, in the above embodiment, the main body portion 10 and the flange portion 20 are formed integrally from a metal such as aluminum, and the insulators 15, which are formed from an insulating material such as a ceramic, are inserted therein. Instead, however, the main body portion 10 and the insulators 15 may be formed integrally from an insulating material such as a ceramic, and the flange portion 20 may be formed from a metal such as aluminum and attached thereto.

This application claims priority based on Japanese Patent Application No. 2016-022982 filed with the Japan Patent Office on Feb. 9, 2016, Japanese Patent Application No. 2016-022983 filed with the Japan Patent Office on Feb. 9, 2016, and Japanese Patent Application No. 2016-128127 filed with the Japan Patent Office on Jun. 13, 2016, the entire contents of which are incorporated into this specification.

The embodiments of this invention in which an exclusive property or privilege is claimed are defined as follows:

What is claimed is:

1. A multipoint spark plug configured to ignite an air-fuel mixture in a combustion chamber of an engine, comprising:

a main body portion formed in a flattened shape, the main body portion being inserted into an insertion hole of the engine such that a tip end portion thereof opposes the combustion chamber;

a pair of side electrodes provided via a gap in a lengthwise direction of the tip end portion; and at least one intermediate electrode provided in the gap between the pair of side electrodes such that a plurality of ignition gaps are formed in the lengthwise direction of the tip end portion.

2. The multipoint spark plug according to claim 1, further comprising electrode holding portions that project into the combustion chamber from the tip end portion, the electrode holding portions holding the side electrodes and the intermediate electrode, wherein the side electrodes and the intermediate electrode project further into the combustion chamber from the electrode holding portions.

3. The multipoint spark plug according to claim 2, wherein the electrode holding portions insulate the side electrodes and the intermediate electrode from the main body portion.

4. The multipoint spark plug according to claim 1, wherein the tip end portion is formed in an identical shape to an inner periphery of the combustion chamber so as to form a part of the inner periphery.

5. The multipoint spark plug according to claim 1, further comprising:

an input terminal connected to one of the side electrodes, the input terminal receiving an ignition current from an ignition coil; and a connection terminal connected to the other side electrode, the connection terminal being connected to the input terminal of another multipoint spark plug.

6. A multipoint ignition engine comprising the multipoint spark plug according to claim 1.

7. The multipoint ignition engine according to claim 6, wherein the multipoint spark plug is provided in a location of the combustion chamber where a temperature of an air-fuel mixture is low.

8. The multipoint ignition engine according to claim 6, further comprising a spark plug provided in an upper portion of the combustion chamber in order to ignite and burn a compressed air-fuel mixture in the combustion chamber together with the multipoint spark plug, wherein the multipoint spark plug is provided in a position that is removed from the spark plug.

9. The multipoint ignition engine according to claim 8, wherein the multipoint spark plug is provided in each of a position removed from the spark plug on an opposite side of an intake valve thereto, and a position removed from the spark plug on an opposite side of an exhaust valve thereto.

10. The multipoint ignition engine according to claim 8, wherein the multipoint spark plug is provided only in a position removed from the spark plug on an opposite side of an exhaust valve thereto.

* * * * *